United States Patent [19]

Spiess et al.

[11] Patent Number: 4,873,795

[45] Date of Patent: Oct. 17, 1989

[54] COVERING FOR A GROUND OPENING

[75] Inventors: Hansruedi Spiess, Delemont; Francois Galvanetto, Alle, both of Switzerland

[73] Assignee: Von Roll, AG., Gerlafingen, Switzerland

[21] Appl. No.: 266,395

[22] Filed: Nov. 2, 1988

[30] Foreign Application Priority Data

May 12, 1988 [EP] European Pat. Off. ..... 88107651.7

[51] Int. Cl.[4] ..... E02D 29/14

[52] U.S. Cl. ..... 52/20; 220/352; 404/25

[58] Field of Search ..... 52/19, 20; 215/355; 220/352; 404/25, 26

[56] References Cited

U.S. PATENT DOCUMENTS 2,100,127 11/1937 Bonsall ..... 52/19
2,100,128 11/1937 West ..... 52/19
4,662,777 5/1987 Newton ..... 52/20 X

FOREIGN PATENT DOCUMENTS 1634624 11/1970 Fed. Rep. of Germany ..... 52/20

*Primary Examiner*—David A. Scherbel
*Assistant Examiner*—Anthony W. Williams
*Attorney, Agent, or Firm*—Helfgott & Karas

[57] ABSTRACT

A covering includes a cover and a frame into which the cover is inserted. A supporting surface of the cover and a cooperating bearing surface of the frame each have a surface inclined with respect to the cover plane. These surfaces are partial peripheral surfaces of a sloping cylinder and/or a sloping cone bounded by sections. As a result the partial surfaces have along their circumferences a different inclination with respect to the cover plane. Therefore the cover can only be inserted in the frame in a specific position. Since as a result of this the same surface positions of the cover and the frame always rest on one another, in the case of such coverings a tight closure can be achieved with a circular or oval opening.

14 Claims, 4 Drawing Sheets

COVERING FOR A GROUND OPENING

BACKGROUND OF THE INVENTION

The present invention relates to a covering for a ground opening, comprising a frame and a cover inserted and supported in the frame. The outer circumferential support surface of the cover and the inner bearing surface of the frame are constructed as corresponding, cooperating surfaces inclined towards the cover plane.

Coverings are used for closing a ground opening, e.g. a shaft opening in a ceiling, and if necessary can be opened without difficulty. Such coverings are known in various different constructional forms. The cover can be rectangular, oval, or circular, whereas the frame generally has a rectangular outer contour, independently of the cover shape. It is required in certan cases for the cover to form a tight termination of the ground opening. In order to satisfy this requirement, known solutions make use of relatively soft rubber packings or a rubber-elastic plastic. Although this leads to a good seal, problems occur if the packing is damaged or displaced on opening, so that during the subsequent closing of the ground opening the necessary sealing action is no longer ensured.

EP 0 142 160 discloses a sealing arrangement for sealing a cover on the bearing surface of the associated frame, in which the aforementioned deficiencies do not occur. The cover can have support surfaces inclined with respect to the cover plane. These surfaces cooperate with corresponding bearing surfaces of the frame. A circular recess is made in the support surface or the bearing surface and this is filled with a sealing compound. If the cover is carefully opened and reinserted, the sealing action is completely maintained. However, if the cover is not carefully removed, the complete sealing is not ensured. It may be necessary to press some sealing compound into the recess and for this purpose there are corresponding openings in the cover of the frame.

The use of the known sealing means is particularly appropriate in the case of covers and frames, whose support surfaces and bearing surfaces are inclined towards the cover plane. If the cover is rectangular, a satisfatory seating of the cover in the frame is ensured. However, if the cover is circular, it is necessary to make use of soft packings and to screw the cover onto the frame, accompanied by the compression of the packing. Thus, when opening such a cover, the aforementioned problems can occur.

SUMMARY OF THE INVENTION

It is an object of the present invention to provide a covering of the aforementioned type in which circular and oval covers can be reliably tightly sealed without leading to the aforementioned disadvantages.

According to the invention this and other objects are attained by the device in which the support surface of the cover and the inner bearing surface of the frame are part surfaces of a sloping cylinder and/or a sloping cone essentialy defined by sections or cuts, in such a way that the inclinations of the support surface of the cover and the bearing surface of the frame have different angles with respect to the cover plane along the circumference thereof.

The invention is described in greater detail hereinafter relative to non-limitative embodiments and the attached drawings.

DETAILED DESCRIPTION OF THE PREFERRED EMBODIMENTS

The invention is based on the idea that in the case of a covering with a circular or oval cover, a good seal can be achieved if the cover or its supporting surface is constructed in such a way that the latter only fits into the bearing surface of the frame in a single position. It is clearly not sufficient for this for the cover to be shaped like a cylinder portion or a frustum, because such a cover could be inserted in random manner into the frame. However, even if the circular cover were replaced by an oval cover, it can still be inserted in the frame in two different positions. However, the situation is different if the cover is constructed as part of a sloping or inclined circular cone or a sloping or inclined cylinder, because then no point of the supporting surface is repeated on the circumference. However, this is the condition that the cover has a supporting surface, which can only fit into the bearing surface of the frame in only one position. The desired cover shapes can be formed from one of two sloping rotation-symmetrical bodies, one being a sloping cylinder and the other a sloping cone.

Figure 1:
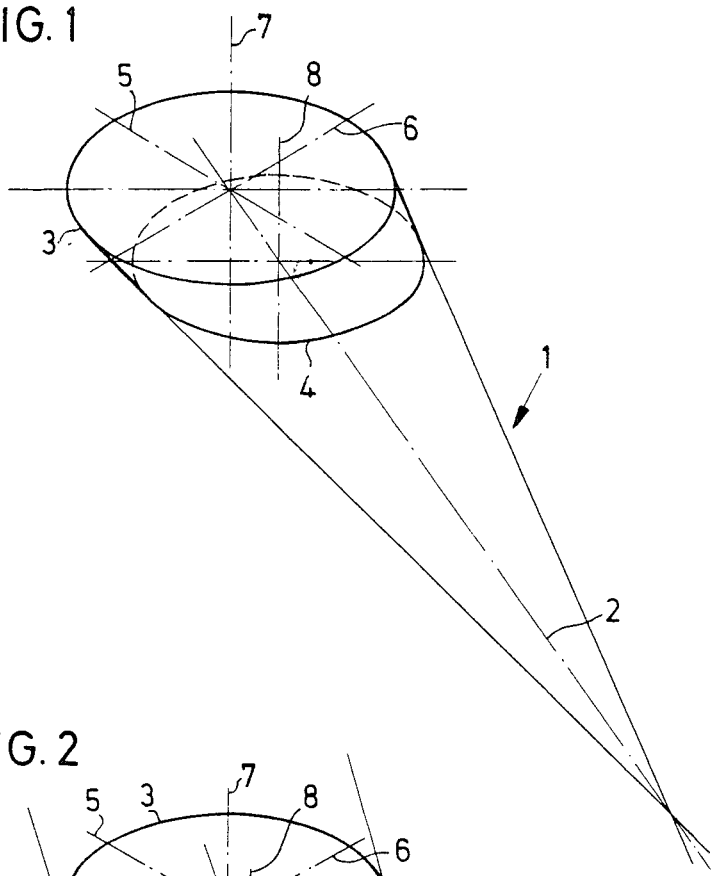
FIG. 1 is a diagrammatic view of the cover for a covering whose circumferential surface is a part surface of the circumference of a sloping cone and which is bounded by two parallel sections roughly corresponding to the base surfaces of the cover.

FIG. 1 diagrammatically shows the shape of a cover, whose supporting surface forms part of the circumferential surface of a sloping cone. The cover then constitutes a part of this sloping cone, which is defined by corresponding sections or cuts.

Figure 2:
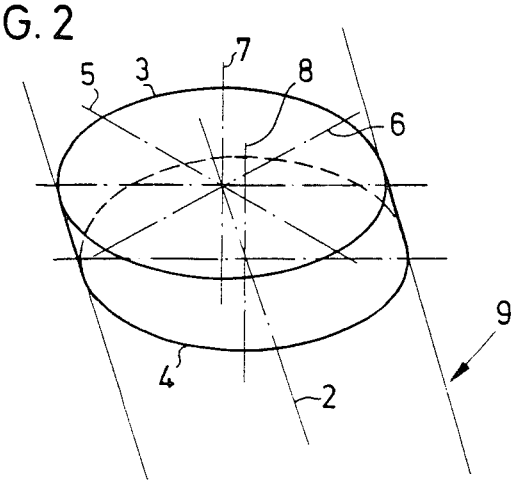
FIG. 2 is a diagrammatic representation of a cover, whose circumferential surface is a part surface of the circumference of a sloping cylinder bounded by two parallel sections corresponding to the base surfaces of the cover.

In FIG. 1 the sloping circular cone is denoed at 1 and its axis at 2. If the upper and lower sections, 3, 4, are circular, this means that the diameters 5, 6, of said sections are at right angles to an axis 7, 8. However, if the sections 3, 4 are oval or eliptical surfaces, this means that the axes of said sections are at right angles to the axis 2 of the sloping circular cone. However, if the starting figure for forming the cover is a sloping circular cylinder 9, cf. FIG. 2, then the upper section 3 and the lower section 4 are circular surfaces and said sections are at right angles to an axis 7, 8. If sections 3, 4 are oval or eliptical surfaces, this means that these sections are at right angles to axis 2 of sloping cylinder 9.

Figure 3:
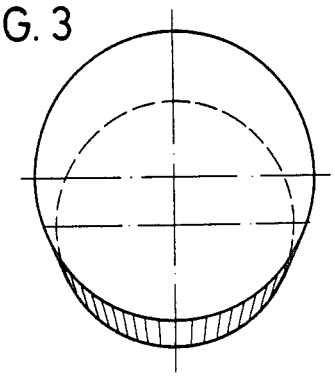
FIG. 3 is a diagrammatic view of a circular cover in the form of a frustum cut out of a sloping cone.
Figure 4:
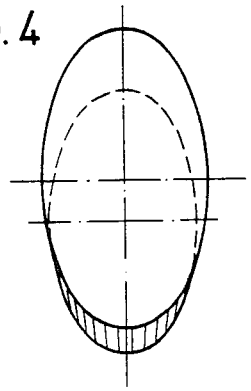
FIG. 4 is a diagrammatic view of an oval cover in the form of a frustum cut out of a sloping cone.
Figure 5:
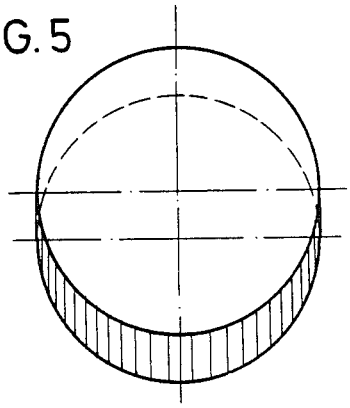
FIG. 5 is a diagrammatic view of a circular cover in the form of a cylinder portion cut out of a sloping cylinder.
Figure 6:
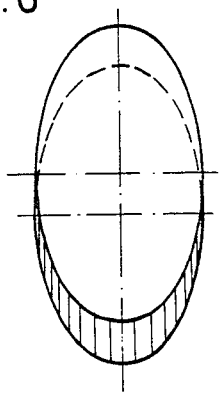
FIG. 6 is a diagrammatic view of an oval cover in the form of a cylinder portion cut out of a sloping cylinder.

Thus, from the sloping circular cone 1 and the sloping circular cylinder 9 four cutouts are obtained, which can be used as covers. They are a circular, sloping frustum according to FIG. 3, an oval, sloping frustum according to FIG. 4, a sloping, circular cylinder portion according to FIG. 5 and a sloping, oval cylinder portion according to FIG. 6.

Figure 7:
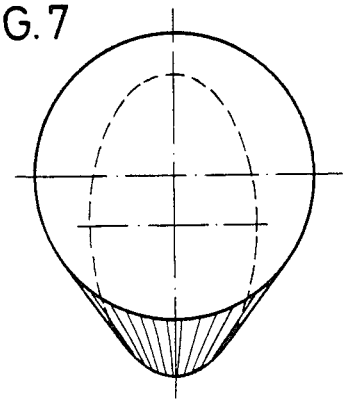
FIG. 7 is a diagrammatic view of the cover in the form of a sloping frustum, whose upper base surface is circular and whose lower base surface is oval.

From these four embodiments, combinations of covers can be derived, in which in the case of a sloping frustum the upper base surface is circular and the lower base surface oval, cf. FIG. 7. In the case of a sloping cylinder portion the upper base surface can be oval and the lower base surface circular, cf. FIG. 8. However, covers are also conceivable, in which the base faces according to FIGS. 7 and 8 are interchanged, i.e. in the case of the sloping frustum the upper lateral face is oval and the lower base face is circular, whereas in the case of the sloping cylinder portion the upper base surface is circular and the lower base surface oval.

Figure 8:
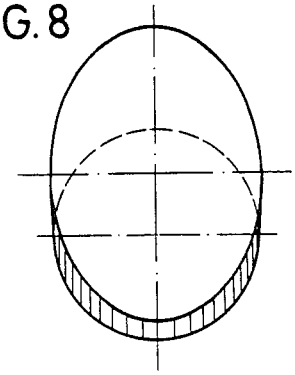
FIG. 8 is a diagrammatic view of the cover in the form of a sloping cylinder portion, whose upper base surface is oval and whose lower base surface is circular.
Figure 9:
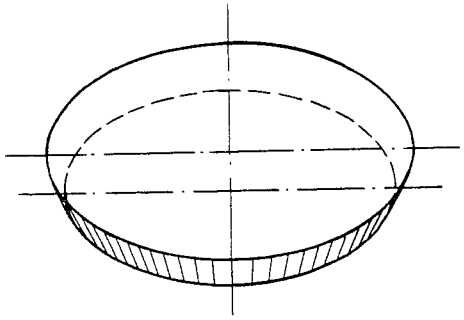
FIG. 9 is a diagrammatic view of the cover in the form of a sloping frustum or a sloping cylinder portion similar to FIGS. 7 and 8, but in which the oval base surface is turned by 90°.

Another variant is shown in FIG. 9 and in this case the oval base surface is turned by 90° compared with the oval base surfaces of FIGS. 7 and 8. This construction could be used in all the embodiments described relative to FIGS. 7 and 8.

Figure 10:
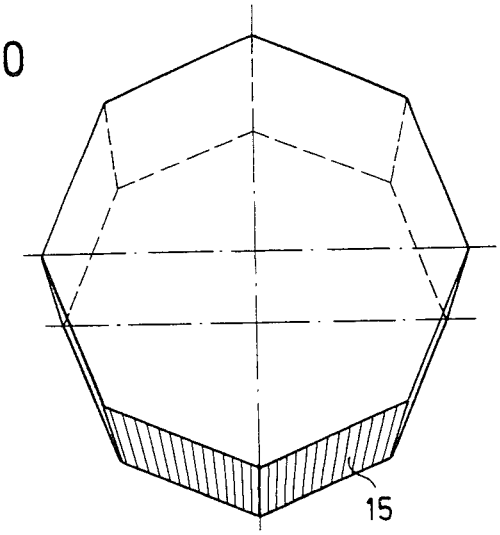
FIG. 10 is a diagrammatic view of the cover in the form of a sloping frustum with polygonal base faces.
Figure 11:
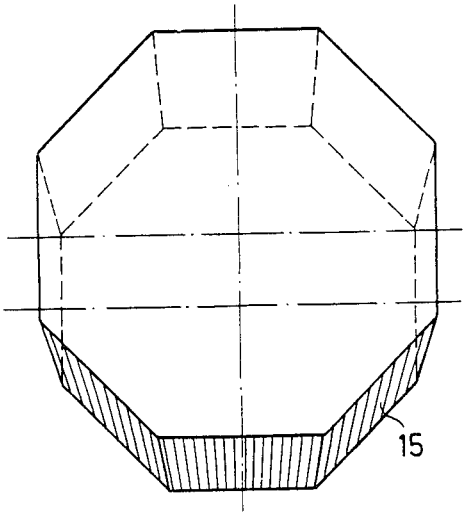
FIG. 11 is a diagrammatic view of the cover in the form of a sloping cylinder portion with polygonal base faces.

Another embodiment is shown in FIGS. 10 and 11, which is based on an idea that the circular and oval base faces can be approximated by polygons. Here again covers are obtained, which have the same characteristics as those with circular or oval base surfaces.

FIG. 10 shows a cover in the form of a sloping frustum with polygonal base surfaces and whose boundary 15 is a regular octagon.

FIG. 11 shows a cover in the form of a sloping cylinder portion with polygonal base surfaces, whose contour 15 is a regular octagon. FIG. 10 roughly corresponds to FIG. 3, and FIG. 11 to FIG. 5. However, in place of the octagon it is possible to use a n-angle with a random number of lateral surfaces.

FIGS. 13 to 16 show the shape of the frame resulting from the construction of the cover as a sloping cone or cylinder. The cover according to FIG. 12 is used as a basis and it can correspond to one of the embodiments according to FIGS. 3 to 6.

Figure 12:
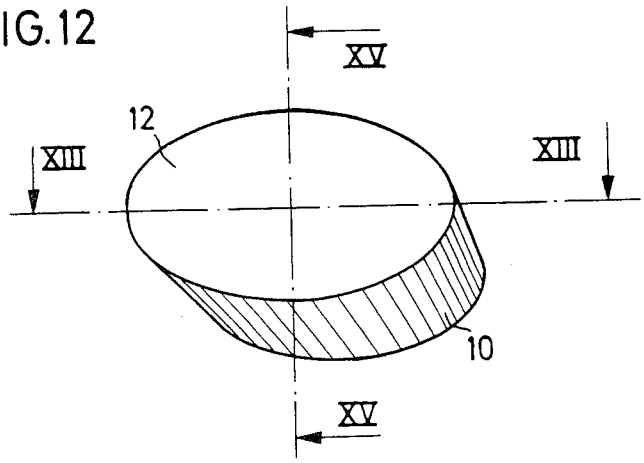
FIG. 12 is a diagrammatic view of the cover in the form of a sloping frustum as in FIG. 3 for assembly with a frame according to FIGS. 14 and 16.
Figure 13:
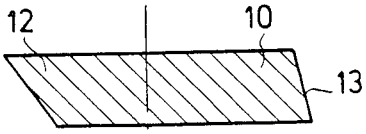
FIG. 13 shows a section along line XIII—XIII in FIG. 12.
Figure 14:
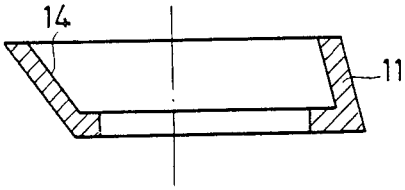
FIG. 14 shows a section of the frame corresponding to the section of the cover taken along line XIII—XIII in FIG. 12.

FIGS. 13 and 14 show the section of cover 10 and a corresponding section of a frame 11 along line XIII—XIII of FIG. 12. It can be seen from this section that the inclinations of the supporting surface of cover 10 and the bearing surface of frame 11 differ from each other on the opposite sides.

Figure 15:
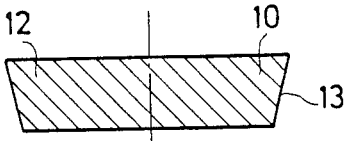
FIG. 15 is a section along line XV—XV in FIG. 12.
Figure 16:
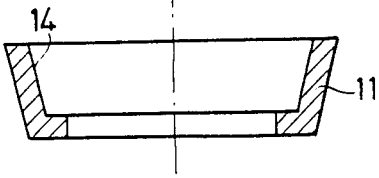
FIG. 16 is a section of the frame corresponding to the section of the cover taken along line XV—XV in FIG. 12.

FIGS. 15 and 16 show a section of cover 10 and a corresponding section of frame 11 along line XV—XV. In this section the supporting surface of the cover 10 and the bearing surface of frame 11 have the same inclination on opposite sides. However, it is not possible to insert the cover 10 in frame 11 other than in the position shown in FIG. 13.

The described coverings have important advantages. As a result of the special shape of the covering, the cover can be easily inserted in the frame and automatically aligns itself. It is also advantageous that the cover cannot be turned in the frame, so that the same point of the supporting surface of the cover is always located on the corresponding point of the bearing surface of the frame. In view of the resulting limited clearance which can be obtained between the cover and the frame and the parts which are to be greased, a reliable sealing of the covering is ensured. It is also possible to use for these embodiments the sealing means according to EP 0 142 160. It is also pointed out that the described coverings can also be used with a locking means, e.g. according to Swiss patent application 4600/87 of 1.11.87 and which are appropriately provided in area 12 of cover 10.

The described covers can be made from different materials, e.g. from cast iron with lamellar or spheroidal graphite, or from plastic. It is necessary to work or machine the supporting surface of the cover and the bearing surface of the frame, and appropriately special machines are used for this.

Diagrammatic representations have been used for showing the different embodiments, because as a result the basic shape of the supporting surfaces of the cover and the bearing surfaces of the frame are more readily apparent. It is obviously possible to e.g. provide ribs on the underside of the cover. The upper base surface can contain a recess which can be filled with bitumen or concrete. The frame can also have additional ribs and webs and can also be constructed in a double-walled manner. The construction of the supporting surface of the cover and the bearing surface of the frame result from the shape chosen.

What is claimed is:

1. Covering for a ground opening, comprising a frame and a cover inserted and supported in the frame, the cover having an external circumferential supporting surface and the frame having an internal bearing surface, said supporting surface and said bearing surface being formed as mating cooperating surfaces inclined with respect to a cover plane, said supporting surface of the cover and said bearing surface of the frame being partial surfaces of a sloping rotation-symmetrical body essentially bounded by sections in such a way that the inclination of the support surface of the cover and the bearing surface of the frame have along a circumference thsreof a different slope with resepct to the cover plane so that the cover can be placed into the frame in only one position.

2. Covering according to claim 1, wherein said rotation-symmetrical body is a sloping cylinder.

3. Covering according to claim 1, wherein said rotation-symmetrical body is a sloping cone.

4. Covering according to claim 3, wherein edges of said partial surfaces bound sections of a sloping frustum with a circular base surface.

5. Covering according to claim 3, wherein edges of said partial surfaces bound sections of a sloping frustum with an oval base surface.

6. Covering according to claim 2, wherein edges of said partial surfaces bound sections of a sloping cylinder with a circular base surface.

7. Covering according to claim 2, wherein edges of said partial surfaces bound sections of a sloping cylinder with an oval base surface.

8. Covering according to claim 3, wherein an edge of a top of the cover bounds a section of a sloping frustum with a circular base surface and an edge of a bottom of the cover bounds a section of a sloping frustum with an oval base surface.

9. Covering according to claim 3, wherein an edge of a top of the cover bounds a section of a sloping frustum with an oval base surface and an edge of a bottom of the cover bounds a section of a sloping frustum with a circular base surface.

10. Covering according to claim 2, wherein an edge of a top of the cover bounds a section of a sloping cylinder with a circular base surface and an edge of a bottom of the cover bounds a section of a sloping cylinder with an oval base surface.

11. Covering according to claim 2, wherein an edge of a top of the cover bounds a section of a sloping cylinder with an oval base surface and an edge of a bottom of the cover bounds a section of a sloping cylinder with a circular base surface.

12. Covering according to claim 1, wherein the supporting surface of the cover and the bearing surface of the frame are formed by faces of a polygon.

13. Covering according to claim 12, wherein the partial surfaces bounded by sections are regular polygons.

14. Covering according to claim 12, wherein the partial surfaces bounded by sections are irregular polygons.

* * * * *